US007806027B1

(12) United States Patent
Gao

(10) Patent No.: US 7,806,027 B1
(45) Date of Patent: Oct. 5, 2010

(54) TORQUE LIMITER WRENCH AND METHOD

(75) Inventor: Hua Gao, Fox Point, WI (US)

(73) Assignee: Bradshaw Medical, Inc., Kenosha, WI (US)

( * ) Notice: Subject to any disclaimer, the term of this patent is extended or adjusted under 35 U.S.C. 154(b) by 348 days.

(21) Appl. No.: 11/983,996

(22) Filed: Nov. 14, 2007

(51) Int. Cl.
*B25B 23/159* (2006.01)

(52) U.S. Cl. ..... 81/482

(58) Field of Classification Search ..... 81/482, 81/483, 467, 472, 473, 478
See application file for complete search history.

(56) References Cited

U.S. PATENT DOCUMENTS 3,893,354 A * 7/1975 Knoll ..... 81/483
4,019,412 A * 4/1977 Kraus et al. ..... 81/482
5,337,638 A * 8/1994 Coss et al. ..... 81/483
5,557,994 A * 9/1996 Nakayama ..... 81/478
6,742,418 B2 * 6/2004 Amami ..... 81/57.39
2007/0039432 A1 * 2/2007 Cutler ..... 81/478

* cited by examiner

*Primary Examiner*—David B Thomas

(57) ABSTRACT

A limiter torque wrench and method having a handle and a jaw pivotally connected together along an axis and for pivoting of the handle upon applying a quantifiable torque. A cam and spring-loaded follower are interconnected between the handle and the jaw. A ratchet is connected to the cam for return of the cam to a starting position and with minimal torque and after application of the limited torque. There is a second ratchet engagable with a workpiece and a pawl engages the second ratchet and a pusher engages the pawl offset from the axis for optimum engagement force on the engaged pawl.

18 Claims, 5 Drawing Sheets

Fig.3
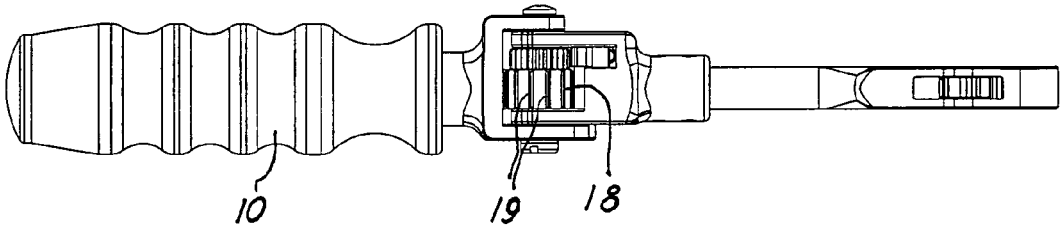
Fig.4
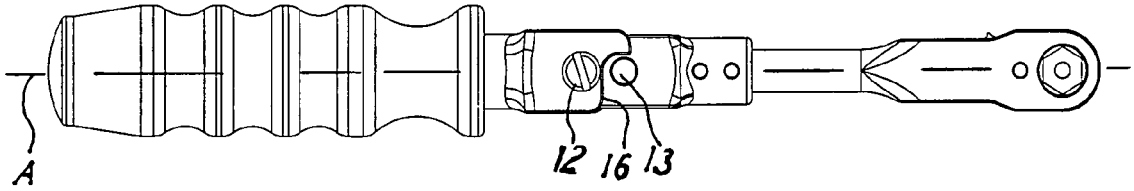
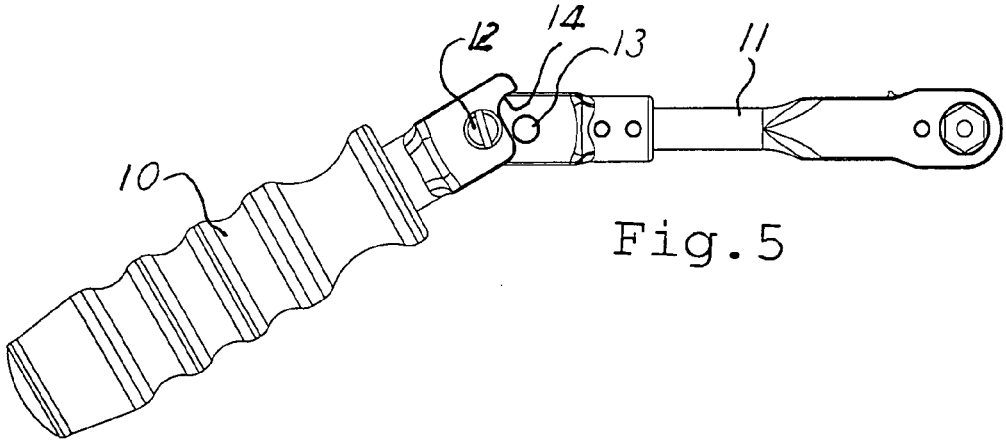
Fig.5

TORQUE LIMITER WRENCH AND METHOD

This invention relates to a torque limiter wrench and a method of applying a limited torque and of controlling a pawl on a ratchet.

BACKGROUND OF THE INVENTION

The prior art is already aware of wrenches for limiting torque. Also it is aware of ratchet and pawl arrangements for ratcheting in both directions of rotation in the application of rotation to a workpiece. Still further, the prior art is aware of handles and jaws pivotally connected together for the pivoting the handle relative to the jaw upon the application of a certain magnitude of torque, to thereby limit the application of the torque.

The present invention improves upon the prior art by having the handle pivot to a return alignment with the jaw after the application of the limited torque and after the consequent pivoting of the handle relative to the jaw, and to do so with only a minimal amount of torque for that return. That minimal amount is much less than the torque limit as applied to the workpiece.

Still further, there is a longitudinal axis for the wrench, and there is a ratchet and pawl combination wherein the pawl receives a tooth-engaging force at a location offset from the longitudinal axis, and a pusher forces on the pawl at the offset location for maximum engagement of the pawl onto the ratchet.

Also, this includes inventive methods for accomplishing the foregoing.

BRIEF DESCRIPTIONS OF THE DRAWINGS

FIG. 3 is a top plan view of FIGS. 1 and 2.

FIG. 4 is a front elevation view of FIG. 3.

FIG. 5 is a front elevation view of FIG. 4 but with the parts in pivoted relationship.

DETAILED DESCRIPTION OF A PREFERRED EMBODIMENT AND METHOD

Figure 1:
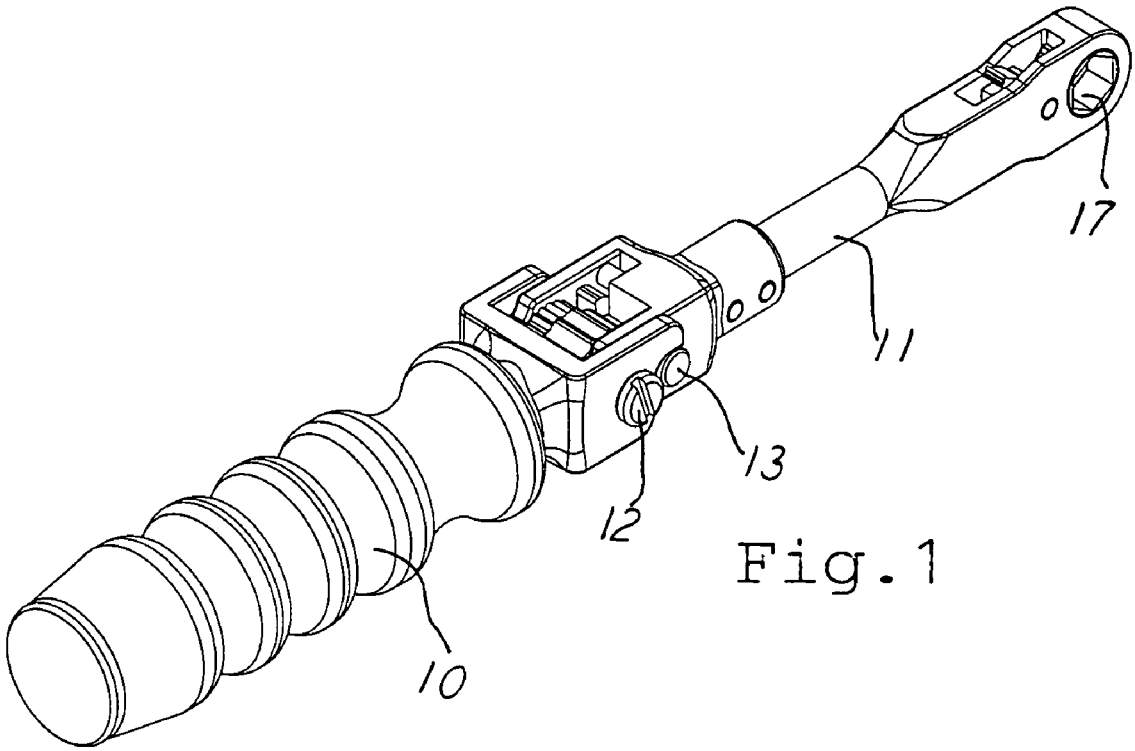
FIGS. 1 and 2 are rear perspective views of the wrench of this invention.
Figure 2:
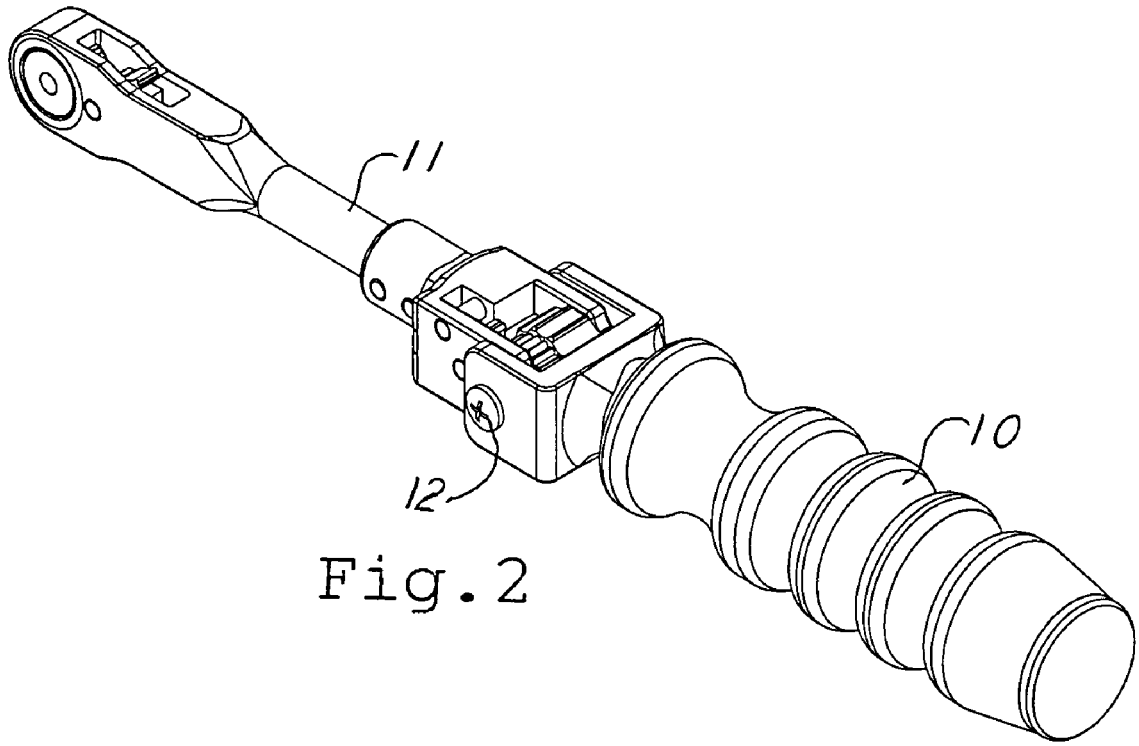
Figure 6:
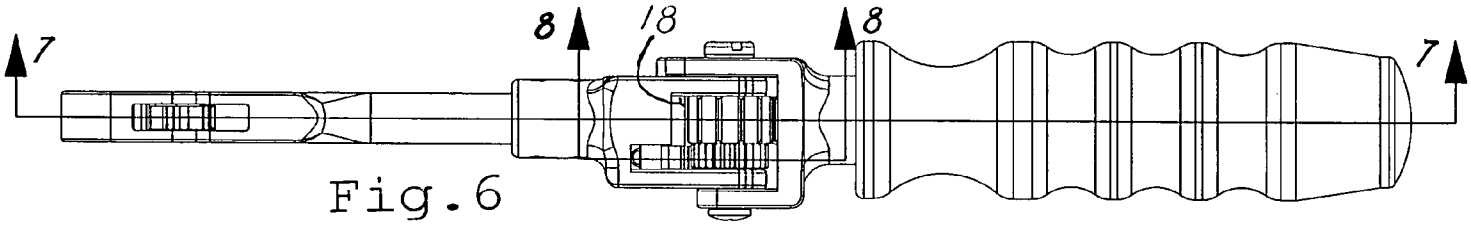
FIG. 6 is a bottom plan view of FIG. 2.

FIGS. 1 thru 5 show the wrench of this invention in both its aligned and pivoted positions. That is, the aligned position is shown in FIGS. 1-4, and that is when the shown wrench is ready for rotating an unshown workpiece such as a nut, bolt, or screw in the usual clockwise direction for tightening. When a quantifiably torque is applied by this wrench, then it pivots to the FIG. 5 position to indicate the application of that maximum torque, and the user can then stop rotating the wrench. This shown instrument is particularly useful in the medical field for rotating threaded fasteners in a patient's body.

The angular degrees of pivot in FIG. 5 is shown to be thirty degrees. So there is a handle 10 and a jaw 11 pivoted together about a pivot pin 12 extending through the two. A pivot stop 13 on the jaw abuts the handle 10 in both directions of handle pivot, as shown in FIGS. 4 and 5, to limit the pivotal relationship of the handle relative to the jaw. Surfaces 14 and 16 on the handle abut the stop 13 on the two different sides thereof for the stopped positions, as shown.

The unshown workpiece would be engaged by the wrench at the ratchet 17 which can be either a one-way or a two-way ratchet, and a two-way is shown. Thus the ratchet 17 is shown with a hexagonally shaped hollow for receiving the unshown workpiece for rotating same.

So the wrench extends along a longitudinal axis A in the aligned mode shown in FIG. 4. In its application to the workpiece, upon reaching the torque limit, the handle 10 pivots to the FIG. 5 mode, so no additional torque should be applied.

Figure 12:
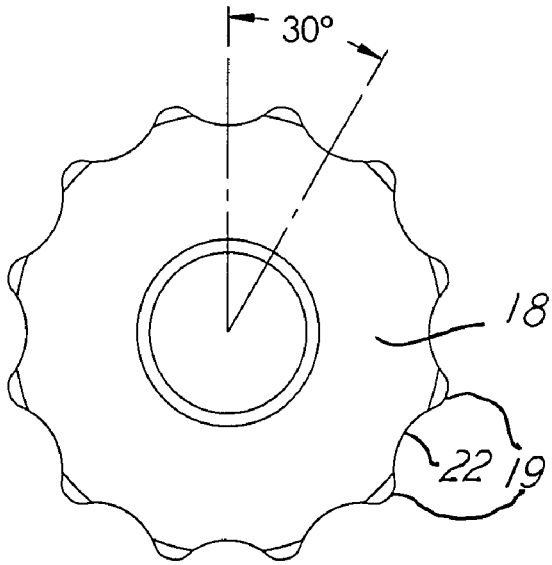
FIG. 12 is an enlarged elevation view of the opposite side of the part in FIG. 11.
Figure 13:
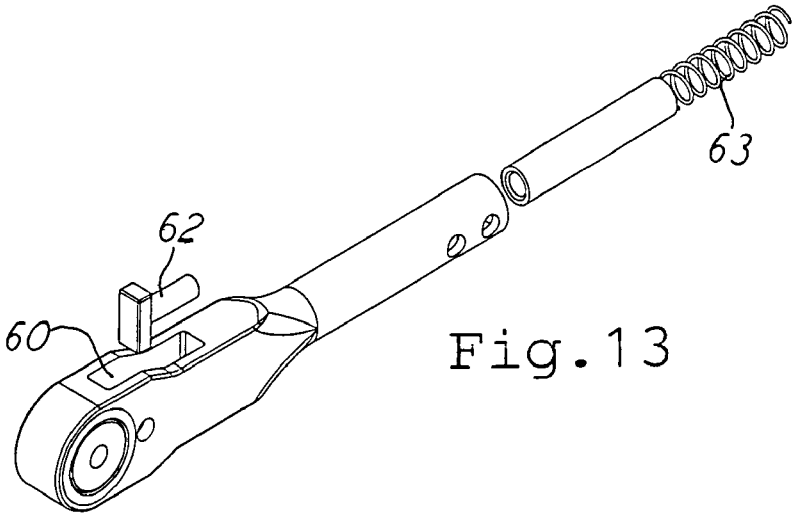
FIG. 13 is a front perspective exploded view of parts in FIG. 7.

The pivot connection between the handle 10 and the jaw 11 is that pivot pin 12. Also centered on the pin 12 and rotatable thereon is an annular cam 18 with twelve radially extending lobes 19. Thus the cam has thirty-degree intervals of lobes and twelve intervening depressions 21, as seen in FIG. 12. That provides for an efficient thirty-degree action explained later and as shown with the angulated handle 10 in FIG. 5. Thirty degrees is a clearly detectable amount for torque limit application, and yet it is not too much when considering the surgical space limitations. The lobes 19 have rounded tips 21 and concave valleys 22 therebetween.

Figure 7:
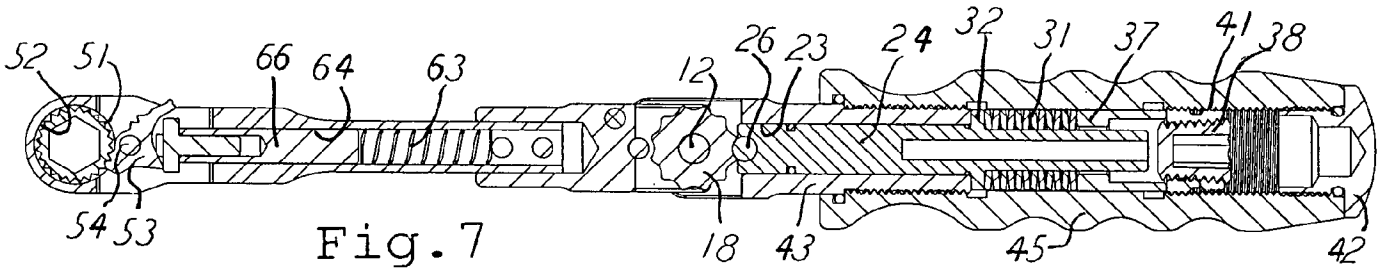
FIG. 7 is a sectional view taken on a plane designated by the line 7-7 of FIG. 6.

FIG. 7 shows that the handle 10 is hollow at 23 and slidably receives a cylindrical plunger 24 movable along the axis A. A cross pin or cam follower 26 is carried by the plunger 24 and is sequentially engageable in the cam valleys 22 to temporarily hold the cam in a rotated position.

Figure 10:
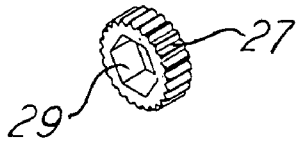
FIGS. 10 and 11 are rear perspective views of parts in FIG. 9.
Figure 11:
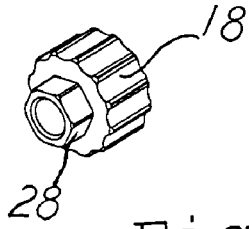

A ratchet 27 is also mounted on the pin 12 and is rotatable thereabout. FIGS. 10 and 11 show that the cam 18 and the ratchet 27 are rotationally connected by a hexagonal interconnection with the cam portion 28 being disposed inside the ratchet opening 29, thus the two always rotate in unison.

Figure 8:
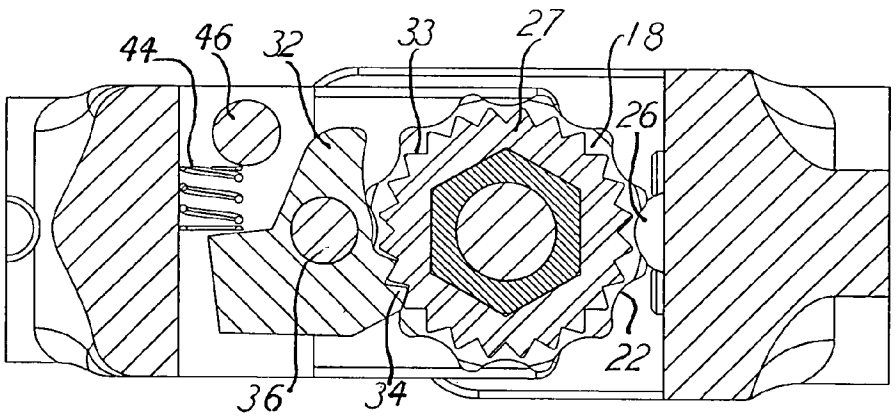
FIG. 8 is an enlarged sectional view taken on a plane designated by the line 8-8 of FIG. 6.
Figure 9:
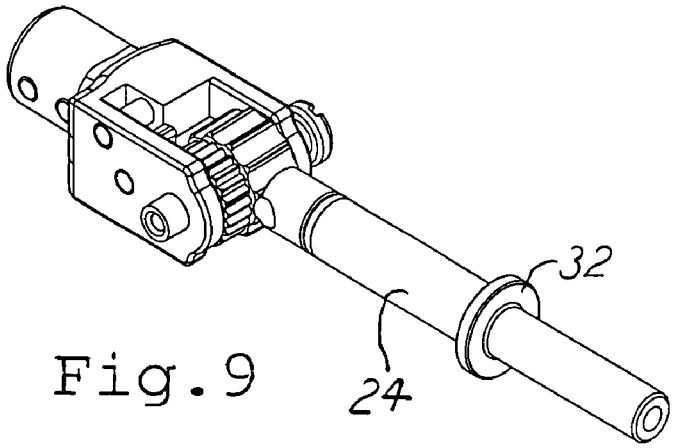
FIG. 9 is a rear perspective view of parts in FIG. 7.

A compression spring 31 yieldingly forces on the plunger at the plunger collar 32 to urge the follower 26 into snug connect with the cam 18, as shown in FIG. 7. Also, the ratchet 27, and thus the cam 18, is held against clockwise rotation by a pawl 32, as seen in FIG. 8. So teeth 33 on the ratchet 27 and teeth 34 on the pawl 32 interlock to resist clockwise rotation of the assembled ratchet and cam. That holds the handle in the aligned mode along the axis A for clockwise tightening of the workpiece, but only to the limit of urging by the spring 31 on the follower 26.

That means that the handle 10 and jaw 11 are aligned and transmit torque therebetween through the cam 18 and the ratchet 27 and the pawl 32 which is pivotal on a pin 36 on the jaw. That torquing continues until the force of the spring 31 on the plunger and the follower lock 26 is overcome by the rotational force on the handle 10, namely to the limit torque.

The limit torque can be adjusted by adjusting the compression spring 31 via the slidable sleeve 37 axially positioned by the split threaded cylindrical adjuster 38 and lock plug 39 inside the cylinder 38 for holding the cylinder 38 in axial abutment against the sleeve 37 by means of the lock plug expanding the cylinder 38 into threaded contact with the threaded interior of the hollow handle and its threads at 41. A cap 42 covers the handle end and it can be removed for access to the adjuster 38 for adjusting the force the spring 31 can apply to the follower 26 and thus adjust the torque limit. The plunger collar 32 abuts a sleeve 43 threaded into the grip 45 to hold the plunger 24 in leftward axial position and have the spring 31 effective on the plunger in the leftward direction as seen in FIG. 7, and urging leftward against the plunger, and thus follower 26.

When the torque exceeds its limit, the follower 26 rides over the cam lobe 18 to the next valley 22, the lower one as seen in FIG. 8, while the cam itself is being held in a non-rotative position by the ratchet 27 and pawl 32. The pawl 32 is urged into tooth contact with the ratchet 27 by a spring 44 supported by a fixed pin 46 on the jaw. So the handle has pivoted to the FIG. 5 angulation.

Next, the cam 18 and ratchet 27 are free to rotate counter-clockwise, as seen in FIG. 8, when the handle is pivoted back to its aligned mode of FIG. 4. The engaged lock 26 which is in that lower valley 22 engages the cam 18 for that counter rotation when the handle pivots into alignment.

It is important to understand that the torque required to return the handle into its aligned mode is much less than the limit torque which pivoted the handle out of its aligned mode. So the workpiece is not loosened in the return, and only that little torque effort is required in the delicate environment of surgery. The ratchet 27 and pawl 32 are thus only one-way effective in resisting rotation, and they permit the easy rotational return of the cam and the ratchet 27 while the lock 26 in the cam valley 22 engages the cam for that return rotation.

The workpiece-engaging end of the wrench can have either a one-way or a two-way ratchet. The drawings show a two-way, and FIG. 7 shows the wrench entire assembly with the ratchet 51 rotatable mounted in the jaw pocket 52 which encloses the ratchet 51 for more than a half-circle for rotational containment thereof. There is a pawl 53 pivotally mounted on a pin 54 on the jaw, and the pawl has two sets of teeth 56 and 57, and the ratchet has a set of teeth 58 engageable with the pawl teeth depending upon the pawl pivoted position.

Figure 14:
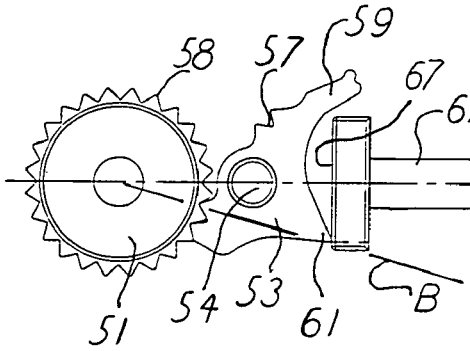
FIGS. 14 and 15 are front elevation views of parts in FIG. 7.
Figure 15:
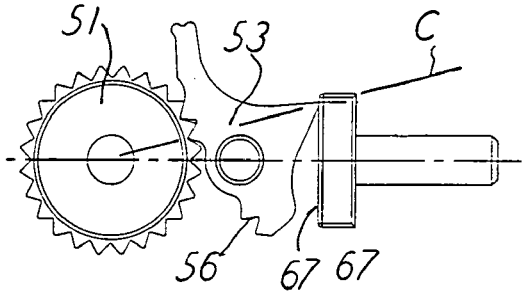
Figure 16:
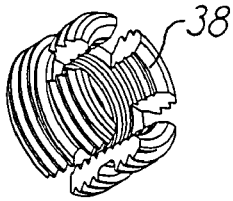
FIGS. 16 and 17 are perspective views of parts in FIG. 7.
Figure 17:
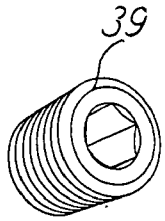

FIGS. 14 and 15 show the two sets of pawl teeth which respectively engage the ratchet teeth 58 for respective driving rotation of the ratchet in rotating the unshown workpiece. The pawl has a lever 59 extending through an opening 60 in the jaw and to the outside of the jaw, as in FIG. 7, for the wrench user to select and pivot the pawl for the desired engagement.

The pawl also has a projection 61 disposed on a plane intermediate the two sets of teeth 56 and 57 and through the pawl pivot 54. When the pawl is engaged, the projection 61 is located offset from the axis A and is on a line B extending through the center of the ratchet and through the tooth engagement location, as shown in FIG. 14. FIG. 15 shows the same line relationship with a line designated C.

A pusher 62 is axially movably mounted on the jaw and is spring-urged by a compression spring 63 toward the pawl. There is a cylindrical opening 64 in the jaw 11 for slidable reception of a plunger 66 on the jaw, and the pusher 62 is contained by the plunger 66 to be urged toward the pawl 53.

The pusher 62 has a flat planar face 67 in sliding contact with the projection 61 such that the projection can slide along the face 67 between the pawl positions of FIGS. 14 and 15. Thus, the pusher has its projection contact points on the respective lines B and C. With that arrangement, the pawl 53 is directly and fully forced onto the ratchet with optimum angulation of application of that force. There is actually a leverage applied to the pawl with, for instance in FIG. 14, the pusher being applied to the projection such that the pawl is actually being leveraged in a clockwise rotated urging for maximum tooth engagement, considering the axis of pawl pivot on pin 54 and the location of the teeth 56 and projection engagements.

Another way of appreciating the novelty is to observe that the location of the contact between the pusher and projection is offset from axis A and on a line parallel to axis A and away from the axis beyond the location of the engagement of the tooth contact between the ratchet and the pawl. So the contact is substantially offset from the axis A.

The foregoing describes a preferred embodiment as required for this disclosure. One skilled in the art that changes can be made in the embodiment, and thusly the scope of the invention should be determined by the appended claims. The method is also described in the foregoing, inherently and directly, and is included as a part of this invention.

What is claimed is:

1. A torque wrench of the type having a jaw for rotating a workpiece and having a handle for rotating said jaw and with said handle being pivotal relative to said jaw upon applying a quantifiable torque to the workpiece, and said wrench having a longitudinal axis and said jaw and said handle extending along said axis and being pivotally joined together by a pin extending transverse to said axis, the improvement comprising:

a cam rotatably interposed between said handle and said jaw for transmitting torque therebetween, a ratchet connected with said cam and rotatable therewith and impeding rotation of said cam in a first direction to thereby transmit torque from said handle to said jaw and permitting rotation of said cam in a direction opposite from said first direction, a connector on said handle and engaged with said cam for the transmission of torque between said handle and said jaw, and a spring imposed upon said connector for effecting the amount of torque transmission between said handle and said jaw and for having said connector override said cam to have said handle pivot relative to said jaw upon application of a predetermined amount of torque from said handle to said jaw.

2. The torque wrench as claimed in claim 1, further comprising:

said handle and said jaw being disposed to extend along said axis and being connected to be relatively pivotal in a first direction off said axis upon application of said predetermined torque and in the absence of rotation of said cam, and said handle and said jaw being connected to be rotatable in a second direction which is opposite to said first direction and to thereby return to extend along said axis and said cam being rotatable in said second direction and along with the pivoting of said handle in said second direction.

3. The torque wrench as claimed in claim 2, further comprising:

a member on said handle and being movable along said axis for urging said spring toward said connector, a threaded adjuster on said handle and operative on said member for urging said member toward said spring, and a threaded lock member on said handle and operative on said threaded adjuster for releasably securing said threaded adjuster in selected positions of urging on said spring.

4. The torque wrench as claimed in claim 2, further comprising:

said cam being annular in shape and having lobes thereon in contact with said connector to have said connector move over said lobes in the pivoting of said handle relative to said jaw.

5. The torque wrench as claimed in claim 4, further comprising:

said connector being disposed to be in contact with said lobes when said handle is in its pivoted position and thereby have said connector rotate said cam upon returning said handle to extend along said axis.

6. The torque wrench as claimed in claim 4, further comprising:

said cam having an endlessly circular periphery and there being twelve lobes on said periphery to thereby have said connector movably index over said cam in increments of thirty angular degrees and thereby have thirty angular degrees of pivot of said handle relative to said jaw.

7. The torque wrench as claimed in claim 4, further comprising:

stops mounted on and operative between said handle and said jaw upon relative pivoted relationship between said handle and said jaw in both directions of rotation.

8. The torque wrench as claimed in claim 1, further comprising:

said cam and said ratchet mounted on said jaw on a common axis and being rotationally connected together for rotation in unison.

9. The torque wrench as claimed in claim 1, further comprising:

a second ratchet rotatably mounted on said jaw for engaging a workpiece, a pawl pivotally mounted on said jaw and having two sets of teeth with each said set being separately engageable with said ratchet at locations offset from said axis, said pawl having a projection on a plane intermediate said two sets of teeth and to the side of said pawl away from said ratchet, a pusher on said jaw and having two contact surfaces offset from said axis for respective engagement with said projection for securing said pawl in teeth contact with said ratchet and said pusher being movable along said axis, and a spring effective on said pusher for urging said pusher into contact with said projection.

10. The torque wrench as claimed in claim 9, further comprising:

a lever on said pawl for pivoting said pawl to and between the two positions of tooth engagement with said ratchet.

11. The torque wrench as claimed in claim 10, further comprising:

said jaw having an opening therein and having said lever extending through said opening for access to thereby pivot said pawl.

12. The torque wrench as claimed in claim 9, further comprising:

said pusher having a flat surface in contact with said projection and on a plane transverse to said axis to have said projection slide on said surface in the pivoting of said pawl between the two positions of ratchet engagement.

13. The torque wrench as claimed in claim 9, further comprising:

said ratchet and said pawl and said pusher all being disposed on said axis.

14. A method of limiting torque applied to a threaded workpiece, comprising the steps of:

pivotally connecting a handle and a jaw to extend along a longitudinal axis and have said handle pivotal relative to said jaw upon applying an amount of a quantifiable torque to the workpiece, imposing a rotatable cam between said handle and said jaw for transmitting unified rotation of said handle and said jaw in a first direction of handle rotation relative to said workpiece and to the amount of the quantifiable torque whereupon said handle pivots relative to said jaw and providing for rotation of said cam in a direction of rotation opposite to said first direction of pivoting of said handle relative to said jaw for the return of said handle along said axis, connecting a ratchet to said cam and having said ratchet and said cam rotatable together and impeding rotation of said cam in said first direction to thereby transmit the quantifiable torque from said handle to said jaw and providing for rotation of said cam in a direction opposite from said first direction, applying a connector on said handle and engaging it with said cam for the transmission of torque between said handle and said jaw, and imposing a spring on said connector for effecting the amount of torque transmission between said handle and said jaw and for having said connector override said cam to pivot said handle pivot relative to said jaw upon application of a predetermined amount of torque from said handle to said jaw.

15. The method for limiting torque as claimed in claim 14, further comprising the steps of:

disposing said handle and said jaw to extend along said axis and connecting said handle to said jaw to have said handle pivotal relative to said jaw in a first direction off said axis upon application of said predetermined torque and in the absence of rotation of said cam, and connecting said handle and said jaw and having said handle rotatable in a second direction relative to said jaw and opposite to said first direction and to thereby return said handle to extend along said axis and connect said cam to be rotatable in said second direction and along with the pivoting of said handle in said second direction.

16. The method for limiting torque as claimed in claim 14, further comprising the steps of:

mounting a member on said handle and have it movable along said axis for urging said spring toward said connector, mounting a threaded adjuster on said handle and have it operative on said member for urging said member toward said spring, and arranging a threaded lock member on said handle to be operative on said threaded adjuster for releasably securing said threaded adjuster in selected positions of urging on said spring.

17. The method for limiting torque as claimed in claim 14, further comprising the steps of:

rotatably mounting a second ratchet on said jaw for engaging a workpiece, pivotally mounting a pawl, on said jaw and having two sets of teeth on said pawl and have each said set separately engageable with said ratchet at locations offset from said axis, arranging said pawl with a projection on a plane intermediate said two sets of teeth and to the side of said pawl away from said ratchet, mounting a pusher on said jaw and having said pusher present two contact surfaces offset from said axis for respective engagement with said projection for securing said pawl in teeth contact with said ratchet and having said pusher movable along said axis, and mounting a spring on said holder for urging said pusher into contact with said projection.

18. The method for limiting torque as claimed in claim 17, further comprising the steps of:

positioning both said locations and said projection offset from said axis along a line substantially parallel to said axis and forcing said pusher onto said projection along said parallel line for tooth engagement of said pawl with said ratchet.

* * * * *